US005738554A

United States Patent [19]

Borger et al.

[11] Patent Number: 5,738,554

[45] Date of Patent: Apr. 14, 1998

[54] ELECTRICAL CONNECTION ELEMENT FOR A HEATED AUTOMOBILE GLAZING

[75] Inventors: Manfred Borger; Heiner Emonts, both of Aachen, Germany

[73] Assignee: Saint-Gobain Vitrage International, Courbevoie, France

[21] Appl. No.: 139,072

[22] Filed: Oct. 21, 1993

Related U.S. Application Data

[63] Continuation of Ser. No. 959,539, Oct. 13, 1992, abandoned, which is a continuation of Ser. No. 758,123, Feb. 12, 1991, abandoned.

[30] Foreign Application Priority Data

Sep. 21, 1990 [DE] Germany ..... 90 13 380 U

[51] Int. Cl.[6] ..... H01R 4/02

[52] U.S. Cl. ..... 439/874; 439/34; 439/502; 219/203; 219/543; 219/541; 338/308; 338/309

[58] Field of Search ..... 439/502, 504, 439/874, 34; 219/203, 543, 541; 338/308, 309

[56] References Cited

U.S. PATENT DOCUMENTS

| | | | |
|---|---|---|---|
| 2,741,753 | 4/1956 | Mekelburg | 439/502 |
| 3,587,030 | 6/1971 | Ohnsorg et al. | 439/502 |
| 3,634,654 | 1/1972 | Peetz et al. | 219/522 |
| 3,980,382 | 9/1976 | Reeder | 439/932 |
| 4,023,008 | 5/1977 | Durussel | 219/522 |
| 4,246,467 | 1/1981 | Boaz | 439/874 |
| 4,658,504 | 4/1987 | Sinharoy et al. | 439/932 |
| 4,878,850 | 11/1989 | Letemps et al. | 439/874 |
| 5,023,403 | 6/1991 | Eckaradt et al. | 439/874 |

FOREIGN PATENT DOCUMENTS

| | | | |
|---|---|---|---|
| 374648 | 12/1989 | European Pat. Off. . | |
| 2122094 | 11/1972 | Germany | 439/502 |
| 2349329 | 4/1974 | Germany . | |
| 34083 | 3/1979 | Japan | 439/502 |
| 137677 | 10/1979 | Japan | 439/502 |

*Primary Examiner*—Gary F. Paumen

*Attorney, Agent, or Firm*—Oblon, Spivak, McClelland, Maier & Neustadt, P.C.

[57] ABSTRACT

An electrical connection element to be brazed on a conductive layer placed on a glazing consists of a segment of flexible metal braid, a plug mounted on one of its ends and a connection piece to be brazed mounted on the other end. The connection piece to be brazed is a piece of rigid sheet metal.

3 Claims, 1 Drawing Sheet

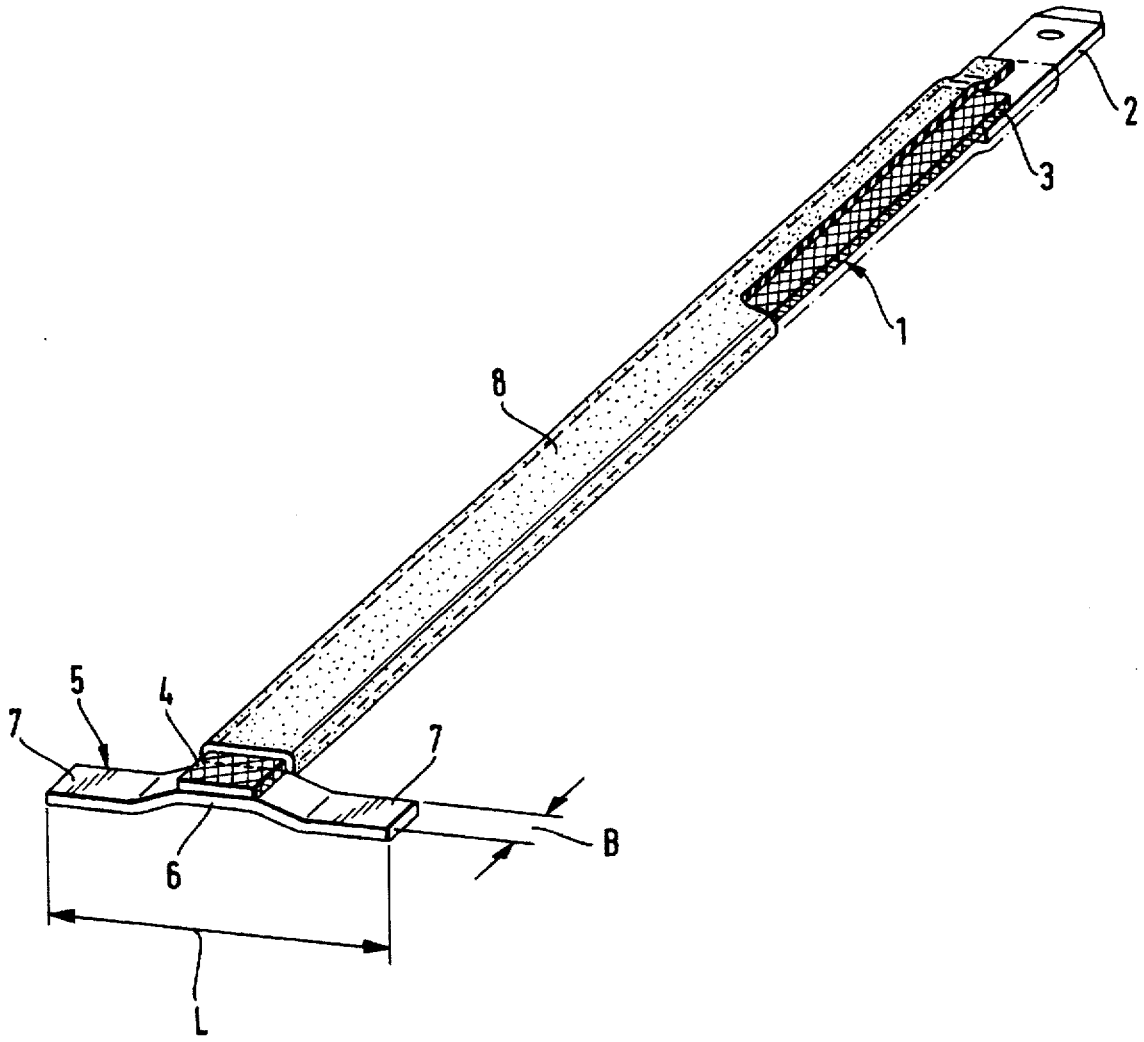
2
3
1
8
5
4
7
7
B
6
L

ELECTRICAL CONNECTION ELEMENT FOR A HEATED AUTOMOBILE GLAZING

This application is a Continuation of application Ser. No. 07/959,539, filed on Oct. 13, 1992 now abandoned, which is a continuation of Ser. No. 07/758,123, filed on Sep. 12, 1991, now abandoned.

BACKGROUND OF THE INVENTION

1. Field of the Invention

This invention relates to an electrical connection element to be brazed on a conductive layer placed on a glazing, in particular an electrically heated automobile glazing consisting of a segment of flexible metal braid, a plug mounted on one of the ends of the braid and a connection piece to be brazed mounted on its other end.

2. Description of the Related Art

Electrical connection elements provided with a connection piece to be brazed and with a plug-in tab are used in great number in heated rear windows for automobiles, in which the heating resistors are applied by silk screen printing to the surface of the glazing in the form of copper paste suitable for printing, then are baked at the tempering and bending temperature of the glazings. During the printing of the heating conductors, bus lines are printed at the same time and the electrical connection elements are brazed on these bus lines after the baking.

An electrical connection element of the specified type comprising a segment of flexible metal braid is known according to document EP 0 374 648. In the case of this known electrical connection element, the connection piece to be brazed is made of two projections of braid which are bent from the segment of metal braid like the arms of a T. The braid projections each have a length of about 8 mm and are preliminarily coated with brazing mixture.

These known electrical connection elements do not easily lend themselves to automatic brazing and handling operations. In particular, the completely automatic positioning of these electrical connection elements on the glazing, using a brazing robot, as described, for example, in document DE-PS 23 49 329, creates difficulties. Because of, in particular, inevitable tolerances of shape and sizes of the connection parts to be brazed consisting of braid projections, the electrical connection elements cannot be stacked in the storage bins of the brazing machine or be placed automatically on the glazing, in a known way, with a suction cup device acting on the connection parts to be brazed.

SUMMARY OF THE INVENTION

The invention has as an object to prepare an electrical connection element of the specified type, with a segment of flexible braid, in such a way that it can be processed in an automatic brazing robot.

According to the invention, this object is achieved by fact that the connection piece to be brazed is a piece of rigid sheet metal connected to the segment of flexible metal braid.

Connection parts to be brazed of rigid sheet metal can be produced with great precision, with constant dimensions. Since such rigid parts have a constant shape which does not change when the braid segment is soldered thereto, the electrical connection elements according to the invention can be easily positioned and brazed on the glazings with brazing robots. Since, further, the connection parts to be brazed exhibit well defined, plane surfaces to be brazed, the flow of the brazing tin during the brazing operation is limited to a continuous surface, so that the brazings can be performed easily, even on relatively narrow bus bars.

BRIEF DESCRIPTION OF THE DRAWINGS

A preferred embodiment of the electrical connection element according to the invention is illustrated in perspective in the accompanying drawing.

DETAILED DESCRIPTION OF THE PREFERRED EMBODIMENT

The segment of flexible metal braid 1 consists, for example, of a ribbon of woven copper of rectangular crosswise section, with a width of about 6 mm and a thickness of about 0.8 mm. At end 3 of the segment of metal braid 1, a flat plug-in tab 2 is soldered on which, during connection to the electric network, a connector is slipped for a corresponding flat plug. End zone 4 of the segment of metal braid 1 is connected to a piece of rigid sheet metal 5, for example by ultrasound soldering. Sheet metal piece 5 forms the projection to be brazed. In this case, it can be a segment of flat sheet metal, whose width and length are suited to the requirements encountered. For example, it can have a width B of about 4 mm and a length L of about 20 to 25 mm. Preferably, it consists of copper sheet metal 0.8 mm thick and can, like flat plug 2, be electroplated. In the case shown, middle part 6 of sheet metal piece 5 is bent and forms a connecting section in the shape of a bridge between the two sections 7 of the projection to be brazed, which are brazed by their lower faces to the conductive layer provided on the glass. Bent middle part 6 of sheet metal piece 5 forms, in a known way, a deformable bridge which reduces the thermal stresses resulting from the different thermal expansion of the glass and the brazed piece of sheet metal. An insulating sheath 8 of a suitable plastic material is applied by contraction on the segment of metal braid 1, except for end part 4 and the plug itself of plug-in tab 2.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. Electrical connection element to be brazed on a conductive layer placed on an electrically heated automobile glazing, comprising:

a segment of flexible metal braid;

a plug mounted on one end of the braid; and a connecting piece to be brazed mounted on another end of the braid;

wherein the connection piece comprises a piece of rigid sheet metal connected to the segment of flexible metal braid by ultrasound soldering, and wherein the piece of sheet metal forming the connection piece comprises a middle section and two end sections, and the middle section is bent so as to take the shape of a bridge element so that only the end sections are braze mounted to the conductive layer.

2. Electrical connection element according to claim 1, wherein the segment of flexible metal braid is covered with an insulating sheath of contractable material.

3. In an automobile glazing having a conductive layer thereon, an electrical connection element comprising:

a segment of flexible metal braid;

a plug mounted on one end of the braid; and a connection piece formed of piece of rigid sheet metal and connected to another end of the segment of flexible metal braid by ultrasound soldering, said connection piece being brazed to the conductive layer, wherein the piece of sheet metal forming the connection piece comprises a middle section and two end sections, and the middle section is bent so as to take the shape of a bridge element so that only the end sections are braze mounted to the conductive layer.

* * * * *